US009828853B2

(12) United States Patent
Chambers

(10) Patent No.: US 9,828,853 B2
(45) Date of Patent: Nov. 28, 2017

(54) APPARATUS AND METHOD FOR DRILLING FLUID TELEMETRY

(75) Inventor: Larry DeLynn Chambers, Kingwood, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 345 days.

(21) Appl. No.: 14/427,069

(22) PCT Filed: Sep. 12, 2012

(86) PCT No.: PCT/US2012/054852

§ 371 (c)(1),
(2), (4) Date: Mar. 10, 2015

(87) PCT Pub. No.: WO2014/042629

PCT Pub. Date: Mar. 20, 2014

(65) Prior Publication Data

US 2015/0240630 A1 Aug. 27, 2015

(51) Int. Cl.
*E21B 47/18* (2012.01)
*E21B 34/06* (2006.01)

(52) U.S. Cl.
CPC ..... *E21B 47/185* (2013.01); *E21B 34/066* (2013.01); *E21B 47/18* (2013.01)

(58) Field of Classification Search
CPC ..... E21B 47/18; E21B 47/182; E21B 47/185; E21B 47/187; E21B 34/063; E21B 34/06; E21B 34/066
See application file for complete search history.

(56) References Cited

U.S. PATENT DOCUMENTS

| | | | |
|---|---|---|---|
| 4,078,620 | A | 3/1978 | Westlake et al. |
| 4,351,037 | A | 9/1982 | Scherbatskoy |
| 4,386,422 | A | 5/1983 | Mumby et al. |
| 4,405,021 | A | 9/1983 | Mumby |
| 4,520,468 | A | 5/1985 | Scherbatskoy |
| 4,535,429 | A | 8/1985 | Russell et al. |
| 4,553,226 | A | 11/1985 | Scherbatskoy |
| 4,630,244 | A | 12/1986 | Larronde |
| 4,641,289 | A | 2/1987 | Jurgens |
| 4,703,461 | A | 10/1987 | Kotlyar |

(Continued)

FOREIGN PATENT DOCUMENTS

| | | | |
|---|---|---|---|
| EP | 0617196 | 6/2000 | |
| WO | WO 2011014389 A2 * | 2/2011 | ..... E21B 33/0355 |
| WO | WO2011036471 | 3/2011 | |

*Primary Examiner* — Robert E Fuller
*Assistant Examiner* — David Carroll
(74) *Attorney, Agent, or Firm* — McGuireWoods LLP

(57) ABSTRACT

A drilling fluid telemetry pulser comprises a housing disposed in a drill string in a wellbore, wherein the drill string has a drilling fluid flowing therein. At least one vent valve is disposed in the housing wherein the at least one vent valve is actuatable to vent a portion of the drilling fluid from an interior of the drill string to an exterior of the drill string to generate a negative pressure pulse in the drilling fluid in the drill string. A hydraulic system provides hydraulic power to actuate the at least one vent valve. A downhole controller comprises a processor and a memory in data communication with the processor wherein the memory contains programmed instructions to control the actuation of the at least one vent valve.

18 Claims, 7 Drawing Sheets

(56) References Cited

U.S. PATENT DOCUMENTS

| | | | | |
|---|---|---|---|---|
| 4,790,393 | A | 12/1988 | Larronde et al. | |
| 4,839,870 | A | 6/1989 | Scherbatskoy | |
| 4,953,595 | A | 9/1990 | Kotlyar | |
| 5,115,415 | A | 5/1992 | Mumby et al. | |
| 5,150,333 | A | 9/1992 | Scherbatskoy | |
| 5,390,153 | A | 2/1995 | Scherbatskoy | |
| 5,586,084 | A | 12/1996 | Barron et al. | |
| 6,414,905 | B1 | 7/2002 | Owens et al. | |
| 6,469,637 | B1 | 10/2002 | Seyler et al. | |
| 6,898,150 | B2 | 5/2005 | Hahn et al. | |
| 6,920,085 | B2 | 7/2005 | Finke et al. | |
| 7,145,834 | B1 * | 12/2006 | Jeter | G01V 11/002 175/38 |
| RE40,944 | E | 10/2009 | Seyler et al. | |
| 7,808,859 | B2 | 10/2010 | Hahn et al. | |
| 8,245,572 | B2 | 8/2012 | Birkett et al. | |
| 2005/0260089 | A1 * | 11/2005 | Hahn | E21B 47/182 417/505 |
| 2008/0136665 | A1 | 6/2008 | Aiello et al. | |
| 2010/0201540 | A1 * | 8/2010 | Li | E21B 47/12 340/853.1 |
| 2012/0126992 | A1 | 5/2012 | Rodney et al. | |

* cited by examiner

APPARATUS AND METHOD FOR DRILLING FLUID TELEMETRY

BACKGROUND OF THE INVENTION

The present disclosure relates generally to the field of drilling fluid telemetry systems and, more particularly, to a pulser for modulating the pressure of a flowing drilling fluid.

Sensors may be positioned at the lower end of a well drilling string which, while drilling is in progress, continuously or intermittently monitor various drilling parameters and formation data and transmit the information to a surface detector by some form of telemetry. Such techniques are termed "measurement while drilling" or MWD. MWD may result in a major savings in drilling time and improve the quality of the well compared, for example, to conventional logging techniques. The MWD system may employ a system of telemetry in which the data acquired by the sensors is transmitted to a receiver located on the surface. Fluid signal telemetry, also called mud pulse telemetry, is one of the most widely used telemetry systems for MWD applications.

Fluid signal telemetry creates pressure pulse patterns in the flowing drilling fluid circulated under pressure through the drill string during drilling operations. The information that is acquired by the downhole sensors is transmitted by suitably encoding the information into the pressure pulses in the fluid stream. The encoded pressure pulses may be detected by a sensor attached to a high-pressure flow line, at the surface. The information may be decoded and used for controlling the drilling operation.

BRIEF DESCRIPTION OF THE DRAWINGS

A better understanding of the present invention can be obtained when the following detailed description of example embodiments are considered in conjunction with the following drawings, in which.

Figure 1:
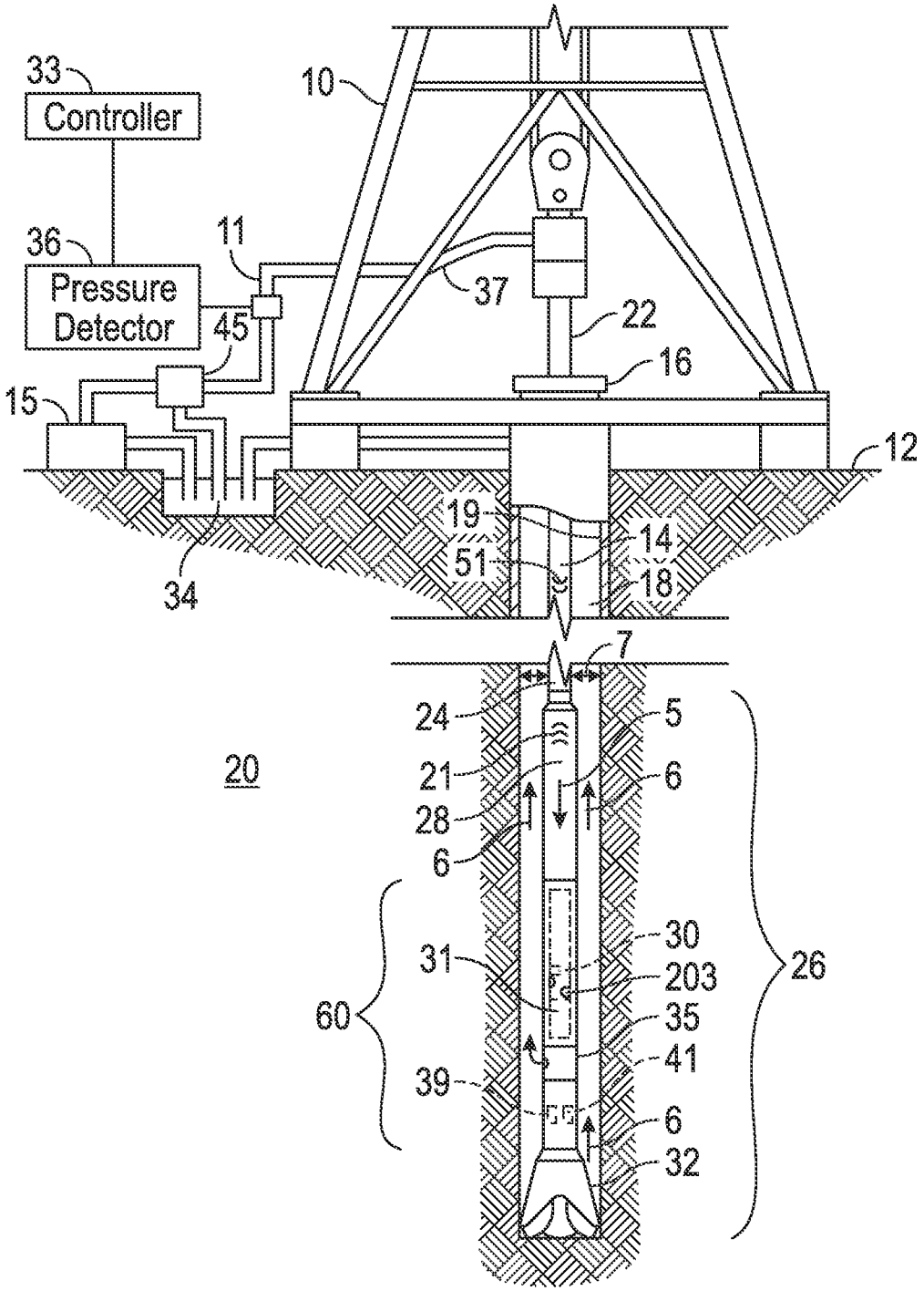
FIG. 1 shows schematic example of a drilling system.

While the examples shown are susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the scope of the present disclosure as defined by the appended claims.

DETAILED DESCRIPTION

Figure 2:
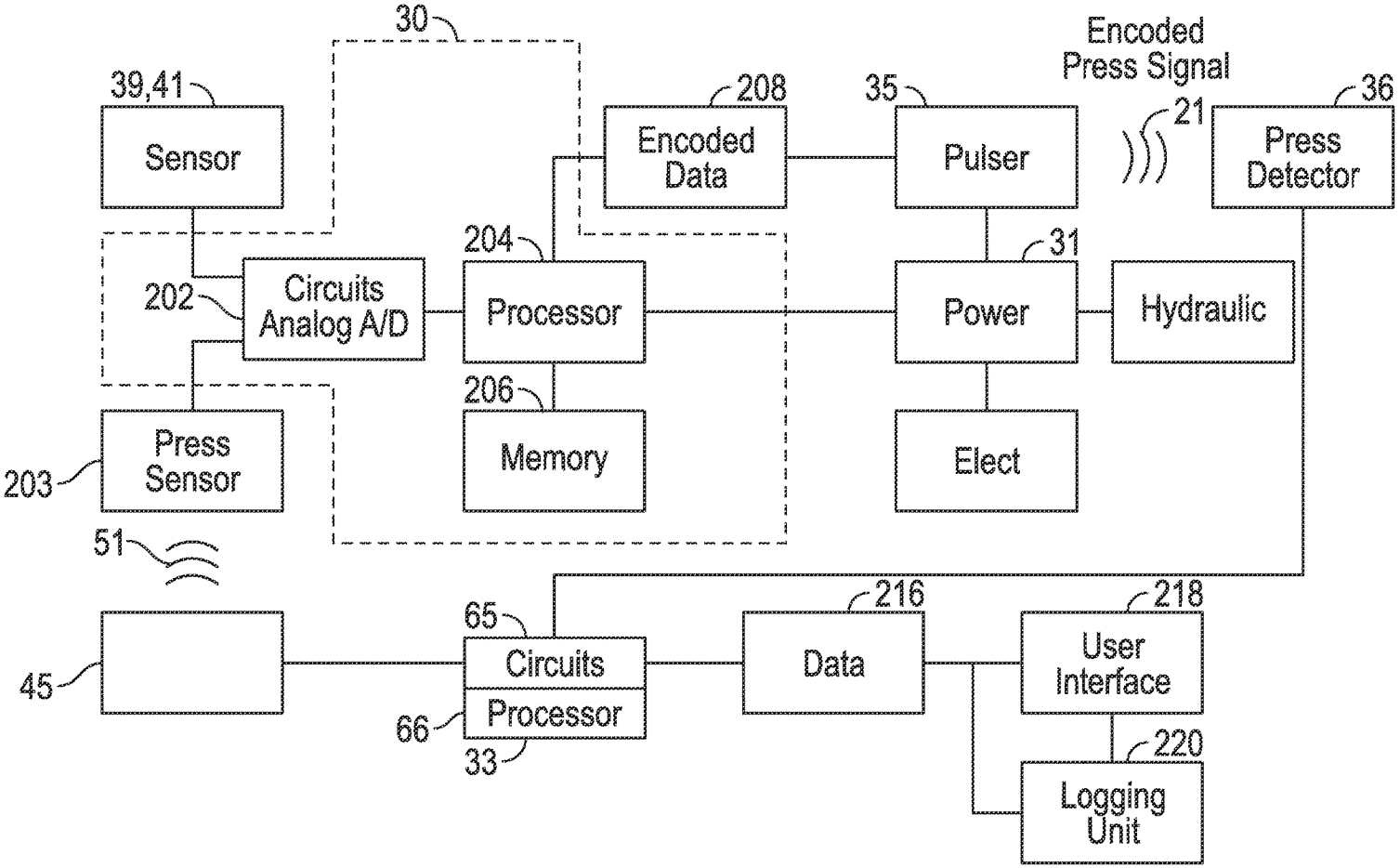
FIG. 2 shows an example block diagram of the acquisition of downhole data and the telemetry of such data to the surface in an example drilling operation.

Referring to FIGS. 1 and 2, a typical drilling installation is illustrated which includes a drilling derrick 10, at the surface 12 of the well, supporting a drill string 14. The drill string 14 extends through a rotary table 16 and into a borehole 18 that is being drilled through earth formations 20. The drill string 14 may include a kelly 22 at its upper end, drill pipe 24 coupled to the kelly 22, and a bottom hole assembly 26 (BHA) coupled to the lower end of the drill pipe 24. The BHA 26 may include drill collars 28, an MWD tool 60, and a drill bit 32 for penetrating through earth formations to create the borehole 18. In operation, the kelly 22, the drill pipe 24 and the BHA 26 may be rotated by the rotary table 16. Alternatively, or in addition to the rotation of the drill pipe 24 by the rotary table 16, the BHA 26 may also be rotated, as will be understood by one skilled in the art, by a downhole motor (not shown). The drill collars add weight to the drill bit 32 and stiffen the BHA 26, thereby enabling the BHA 26 to transmit weight to the drill bit 32 without buckling. The weight applied through the drill collars to the bit 32 permits the drill bit to crush the underground formations, in the example shown. While shown as a vertical well, it should be understood, that the present disclosure is intended to also cover inclined and horizontal wells.

As shown in FIG. 1, BHA 26 may include an MWD tool 60, which may be part of the BHA 26. As the drill bit 32 operates, drilling fluid 5 (commonly referred to as "drilling mud") may be pumped from a mud pit 34 at the surface by pump 15 through standpipe 11 and kelly hose 37, through drill string 14, to the drill bit 32. The drilling mud is discharged from the drill bit 32 and carries away earth cuttings made by the bit. After flowing through the drill bit 32, the return drilling fluid 6 flows back to the surface through the annular area, A, between the drill string 14 and the borehole wall 19, where it is collected and returned to the mud pit 34 for filtering. The circulating column of drilling mud 5 flowing through the drill string 14 may also function as a medium for transmitting pressure pulses 21 encoded with information from the MWD tool 60 to the surface. In one embodiment, a downhole pulser 35 is in data communication with a controller 30 of MWD tool 60. Pulser 35 may be configured, as described below, to generate the pressure pulses 21 transmitted to the surface through drilling fluid 5.

MWD tool 60 may also comprise sensors 39 and 41, which may be operatively coupled to appropriate interface circuitry 202, see FIG. 2, which produces digital data electrical signals representative of the measurements obtained by sensors 39 and 41. While two sensors are shown, one skilled in the art will understand that a smaller or larger number of sensors may be used without departing from the principles of the present invention. The sensors 39 and 41 may be selected to measure downhole parameters including, but not limited to, environmental parameters, directional drilling parameters, and formation evaluation parameters. Such parameters may comprise downhole pressure, downhole temperature, the resistivity or conductivity of the drilling mud and earth formations, the density and porosity of the earth formations, as well as the orientation of the wellbore.

The MWD tool 60 may be located proximate to the bit 32. Data representing sensor measurements of the parameters discussed may be generated and stored in the MWD tool 60. Some or all of the data may be transmitted in the form of pressure pulses by pulser 35, through the drilling fluid 5 in drill string 14. A pressure pulse 21 pattern travelling upward in the column of drilling fluid may be detected at the surface by a pressure detection sensor 36. The detected pressure pulses 21 may be decoded in surface controller 33. The pressure pulse signals may be encoded digital representations of measurement data indicative of the downhole drilling parameters and formation characteristics measured by sensors 39 and 41. Surface controller 33 may be located proximate the rig floor. Alternatively, surface controller 33 may be located away from the rig floor. In one embodiment, surface controller 33 may be incorporated as part of a logging unit.

FIG. 2 shows a block diagram of the acquisition of downhole data and the telemetry of such data to the surface in an example drilling operation. Sensors 39 and 41 acquire measurements related to the surrounding formation and/or downhole conditions and transmit them to downhole controller 30. Downhole controller 30 may comprise downhole circuits 202 comprising analog and/or digital circuits and analog to digital converters (A/D). Sensor measurements are input to circuits 202 and the resulting data are transmitted to processor 204 that is in data communication with a memory 206. Processor 204 acts according to programmed instructions to encode the data into digital signals according to a pre-programmed encoding technique. One skilled in the art will appreciate that there are a number of encoding schemes that may be used for downhole telemetry. The chosen telemetry technique may depend upon the type of pulser used. Processor 204 outputs encoded data 208 to pulser 35. Pulser 35 generates encoded pressure pulses 21 that propagate through the drilling fluid in drill string 14 to the surface. Downhole power section 31 provides suitable electrical and/or hydraulic power to operate the downhole circuitry and pulser operation as described below.

Pressure pulses 21 are detected at the surface by pressure detector 36 and are transmitted to surface controller 33 for decoding. Pressure detector 36 may comprise a piezoelectric pressure transducer, a strain gage pressure transducer, a fiber optic sensor, or combinations thereof, suitably mounted on the high-pressure standpipe 11. Surface controller 33 may comprise interface circuitry 65 and a processor 66 for decoding pressure pulses 21 into data 216. Data 216 may be output to a user interface 218 and/or an information handling system such as logging unit 220. Alternatively, in one embodiment, the controller circuitry and processor may be an integral part of the logging unit 220. In one embodiment, a surface downlink pulser 45 may transmit downlink pulses 51 containing instructions and/or data from the surface to a downhole pressure sensor 203 in data communication with the downhole controller 30. The downlink signals are decoded and acted upon by the downhole controller 30. In one example, such a downlink signal may indicate the need to increase the transmitted pulse amplitude to better enable surface detection. In at least one embodiment, it may be advantageous to transmit data and/or instructions from the surface to the downhole system. In one example, a surface downlink pulser 45 may transmit encoded pressure pulses containing such data/instructions to a downhole pressure sensor 203. The pressure pulses may be received by pressure sensor 203 and decoded by instructions in downhole controller 30. Examples of such downlink communications are described further below. Alternatively, any other technique known in the art for downlinking data/instructions may be used.

Figure 3:
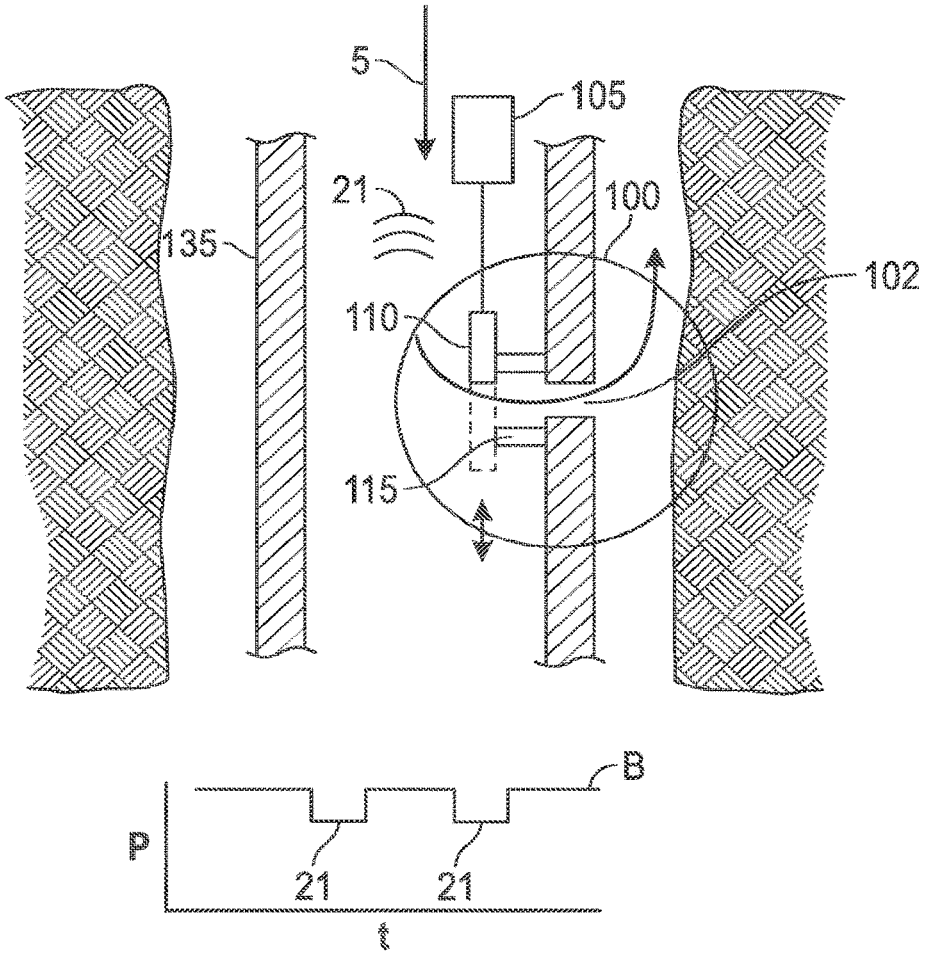
FIG. 3 (Prior Art)
FIG. 3 shows an example of a prior art negative pulser suitable for use in a fluid telemetry system.

FIG. 3 shows a schematic example of an embodiment of a pressure pulser 135 that may be used to generate negative pressure pulses 21 in drilling fluid 5. As shown, pulser vent valve 100 is disposed in pulser 135. Vent valve 100 comprises a gate 110 that is moved back and forth against seat 115, between an open position and a closed position. Gate 110 is moved by actuator 105. In the closed position, gate 110 blocks drilling fluid from flowing through a flow passage 102 between the inside of drill string 114 and the annulus, A. In the open position, the gate 110 is moved away from seat 115 such that flow passage 102 is opened to allow a portion of drilling fluid 5 to intermittently pass, or vent, through flow passage 102 to annulus 7. The venting of drilling fluid 5 through passage 102 generates a negative pressure pulse 21, relative to the non-pulsing baseline pressure, B, in the drilling fluid inside drill string 14. The negative pulse propagates to the surface through drilling fluid 5 inside of drill string 14.

Prior art negative pulsers may incorporate large electrical solenoids as actuators requiring battery packs and capacitor banks to move the gate back and forth to create the fluid pressure pulses. Such devices may comprise a large number of interconnected elements susceptible to damage by the high temperature and/or shock and vibration experienced in downhole drilling. Such damage may adversely affect system cost and reliability. In addition, common negative pulsers employ a single vent valve, as shown in FIG. 3. Such a vent valve may be sized to generate a predicted pulse amplitude over a predetermined flow range. However, should drilling operations require a flow rate outside of the predetermined flow range, the operation of the pulser, or the pulse telemetry system, may be compromised. For example, if a new operating flow rate is below the predetermined range, the pulse generated may be too small to be reliably detected at the surface. Conversely, if the operating flow rate is higher than the predetermined flow range, accelerated erosive wear may damage the seat. These conditions may require pulling the system out of he well to insert different size components to address the flow rate changes.

Figure 4:
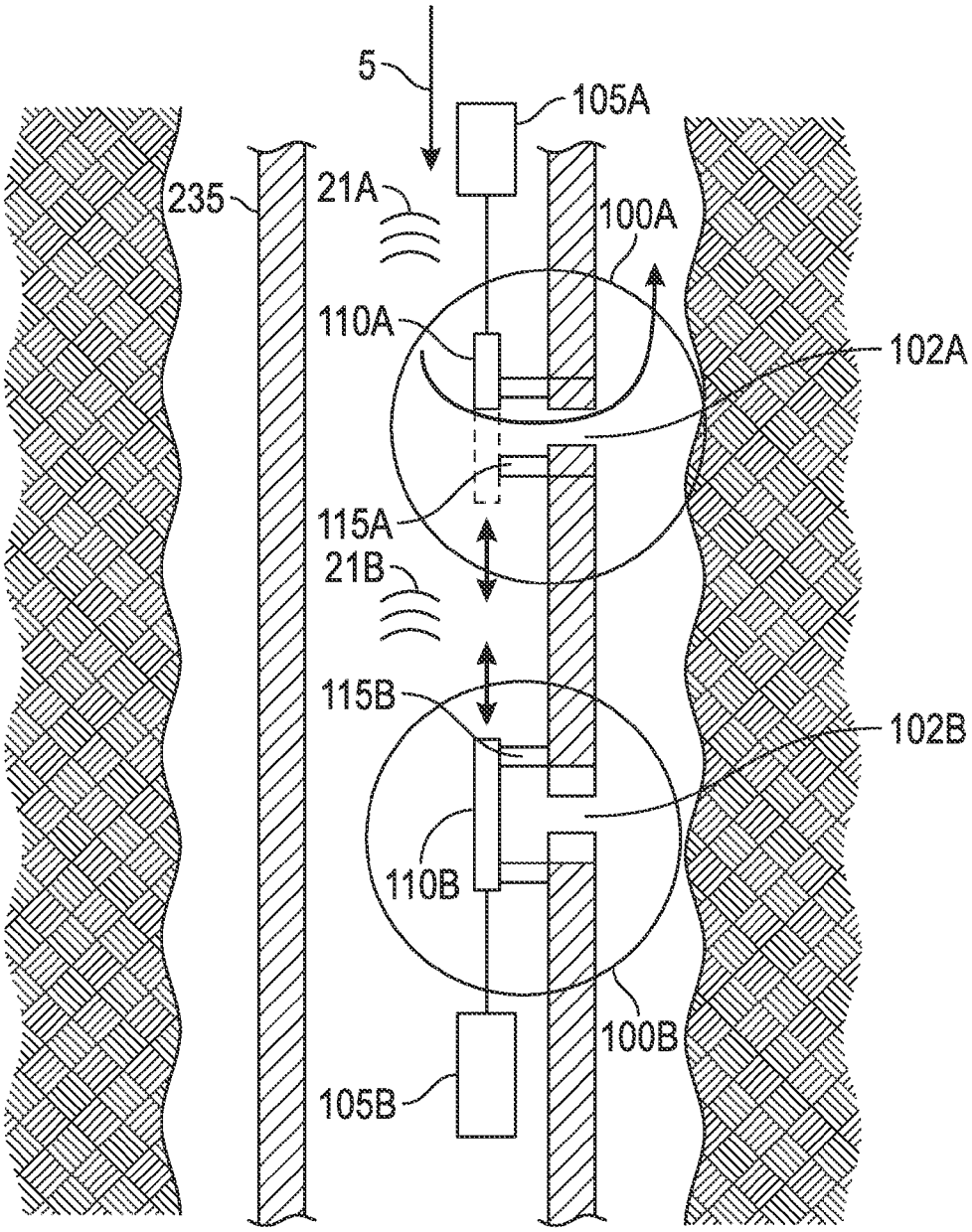
FIG. 4 shows a schematic representation of a negative pulser assembly that may comprise a plurality of vent valves.

FIG. 4 shows a schematic representation of a negative pulser assembly 235 that may comprise a plurality of vent valves. As used herein, the term plurality means at least two. Two vent valves 100A and 100B are independently operable by a controller (not shown) to vent fluid from inside drill string 14 to annulus 7, to generate negative pulses. While shown with two vent valves 100A and 100B, additional vent valves may be employed in the present system. Each vent valve may be independently operable. As shown in FIG. 4, vent valve 100A is actuated by actuator 105A. Actuator 105A may comprise a hydraulic cylinder powered by a downhole hydraulic system, described below. Such a hydraulic cylinder may be an individual part, or may be formed as a cavity in a downhole tubular member, for example a drill collar member. Actuator 105A moves gate 110A in relation to valve seat 115A to vent fluid through flow passage 102A to generate a pressure pulse 21A in drill string 14. Vent valve 100B works similarly, with actuator 105B moving gate 110B in relation to valve seat 115B to vent fluid through flow passage 102B thereby generating pressure pulses 21B in drill string 14.

Figure 5:
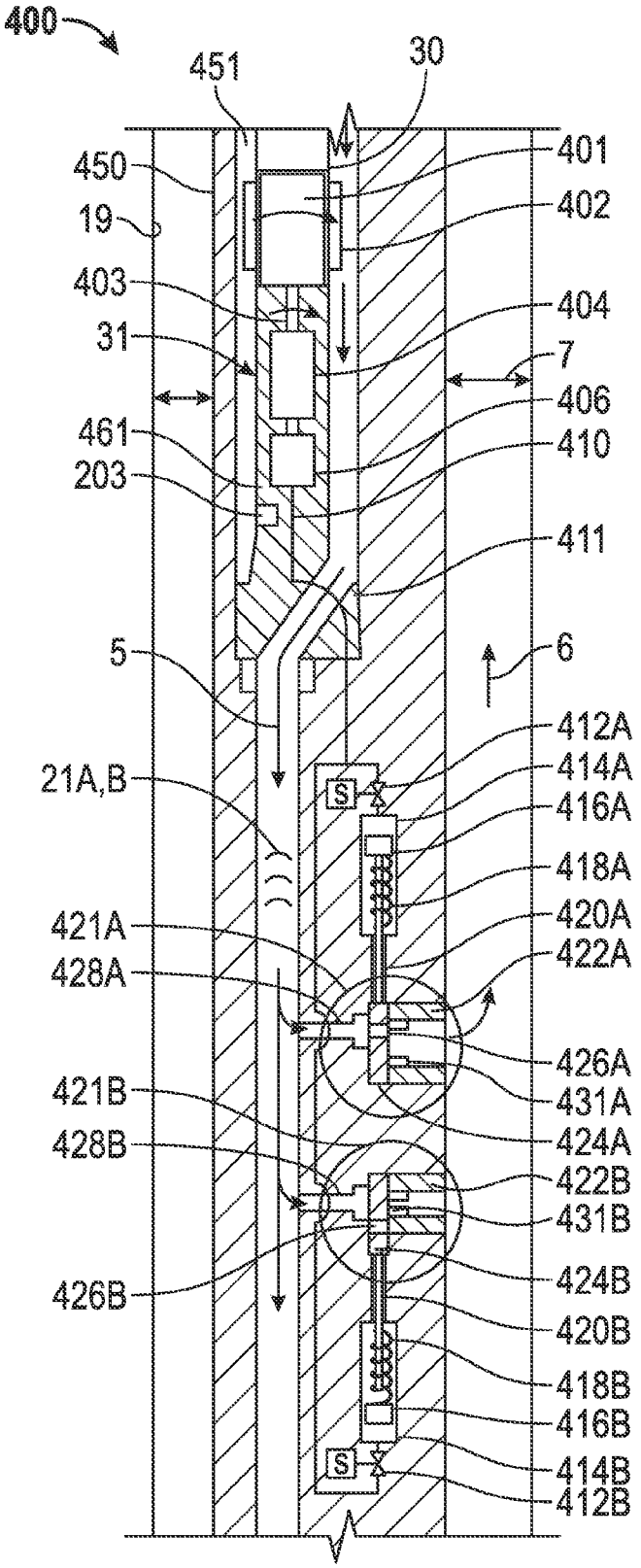
FIG. 5 shows an example embodiment of a pulser assembly comprising a plurality of vent valves.

FIG. 5 shows an example embodiment of a pulser assembly 400. Pulser assembly 400 may comprise at least two independently actuatable vent valves 421A and 421B, a power section 31, and a downhole controller 30. In the example shown, pulser assembly 400 also comprises a pulser housing 450 that is insertable into drill string 14, see FIG. 1. Drilling fluid 5 flows through an axial flow passage 451 in pulser housing 450, as shown. Vent valves 421A and 421B are located in a side wall of pulser housing 450. The following description of valve operation is applicable to each vent valve. As such, the designators A and B are used during the description. The respective A designations indicate association with vent valve 421A, and the B designation indicates association with vent valve B. Vent valve 421A,B may comprise a gate 424A,B and a seat 422A,B. Gate 424,B comprises a gate flow port 426A,B to allow flow there-through. A flow passage 428A,B is aligned with seat 422A,B and allows drilling fluid 5 to flow through seat orifice 431A,B of seat 422A,B when gate port 426A,B is aligned with seat orifice 431A,B. Seat orifice 431A,B is sized to control the pulse amplitude based at least partly on the flow area of the orifice and the pressure difference between the inside of drill string 14 and the annulus 7 at the location of the pulser. Gate 424A,B is coupled by piston shaft 420A,B to a hydraulic actuation piston 416A. Piston 416A,B is movable within cylinder cavity 414A,B. The actuation of solenoid operated valve 412A,B allows high pressure hydraulic fluid to enter cylinder cavity 414A,B and force piston 416A,B toward the opposite end of cylinder cavity 414A,B. This movement aligns gate port 426A,B with seat orifice 431A,B and allows drilling fluid 5 to flow from the inside of drill string 14 to the annulus 7, with the attendant generation of a pressure pulse 21A,B in drilling fluid 5 inside drill string 14. When solenoid valve 412A,B is deactivated, return spring 418A,B forces the piston 416A,B back to the unpressured position, and moves gate 424A,B back to the no flow position. Valve gate 424A,B and valve seat 422A,B may be made out of erosion resistant materials including, but not limited to, tungsten, tungsten carbide, and silicon carbide.

Electrical and hydraulic power is supplied by power section 31. In the example shown in FIG. 5, an impeller 401 has blades 402 that intercept at least a portion of drilling fluid 5, causing impeller 401 to rotate. In one example, impeller 401 may be magnetically coupled to a drive shaft 403 inside power section housing 461. Drive shaft 403 drives an electrical generator 404 for electrical power, and a positive displacement hydraulic pump 406 to generate hydraulic power. The internal portion of power section housing may be filled with hydraulic oil 407 such that the internal portion is pressure compensated with the downhole pressure. A pressure compensation mechanism (not shown), for example, a sliding piston, or a flexible bellows may be used to provide such pressure compensation. The oil in the internal portion of power section housing may be used as the reservoir 408 for the positive displacement pump 406. Pump 406 may be any suitable positive displacement pump, including, but not limited to: a swashplate pump, a gear pump, and a gerotor pump. Such pumps are known in the art and are not discussed in detail herein.

As used herein, the term electrical generator is intended to encompass both DC generator and AC alternator configurations. Electrical power from generator 404 is routed to controller module 30 for conditioning and routing to the appropriate downhole devices. Alternatively, electrical power may be derived from downhole batteries, or a combination of a downhole generator and downhole batteries. One skilled in the art will appreciate that wires are commonly routed through passages formed in downhole tools. Such details may be device dependent and are not discussed herein. Similarly, hydraulic routing in downhole tools is within the skill in the art and is not discussed in detail herein. Hydraulic fluid may be routed through flow line 410 and through crossover member 411 to establish hydraulic communication with solenoid valves 412A,B. Return flow may be similarly routed back to hydraulic pump 406. Such routing details are known in the art and are not shown herein.

Figure 6:
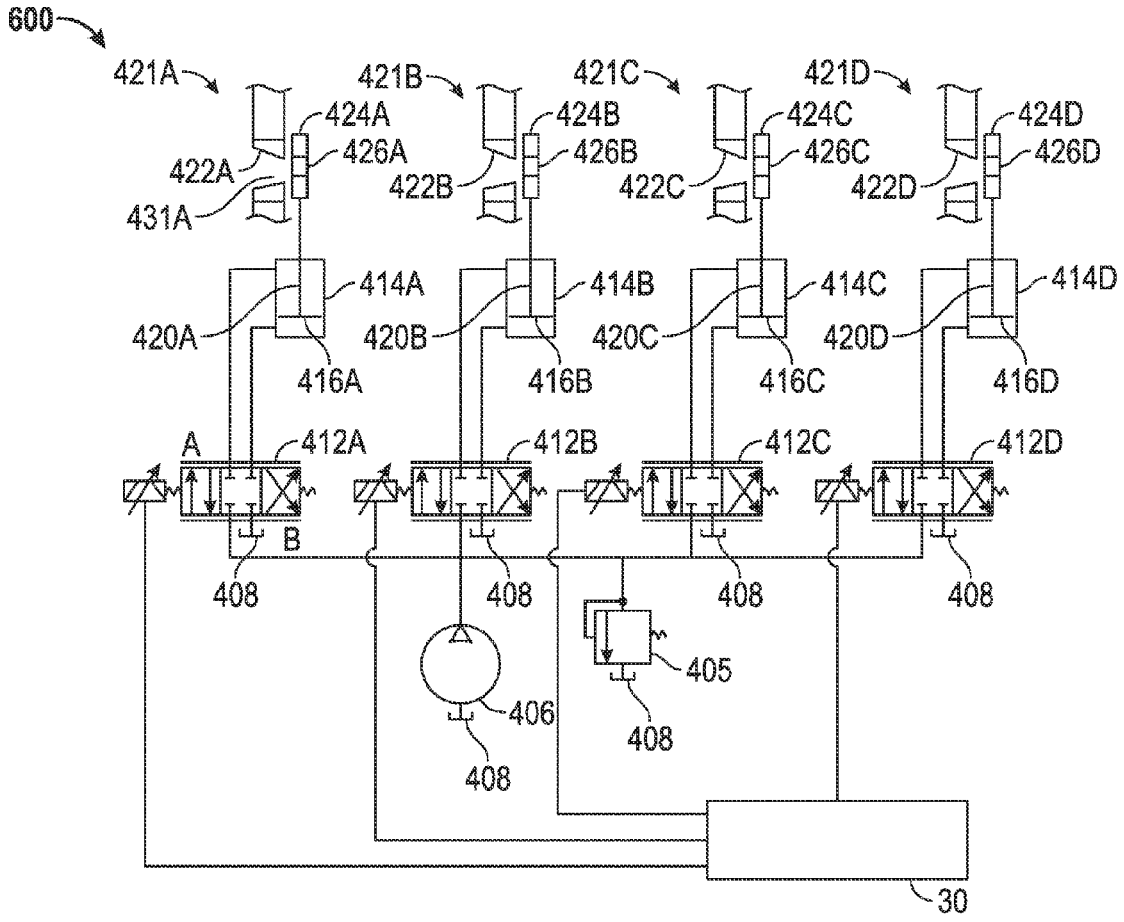
FIG. 6 shows an example hydraulic schematic for a pulser assembly comprising a plurality of vent valves.

FIG. 6 shows an example schematic of a hydraulic system 600 for use with one, or more, vent valves, as described above. In the example shown, the hydraulic system 600 may individually operate four vent valves 421A-D. As shown, positive displacement hydraulic pump 406 takes hydraulic fluid from reservoir 408 and circulates it at through the hydraulic lines to solenoid valves 412A-D. In the example shown, solenoid valves A-D each have three operating positions. The following describes the operation of valve 412A, but is independently applicable to each solenoid valve. In the unenergized, default position, shown in FIG. 6, hydraulic fluid flow is prevented from circulating through the solenoid valve. The hydraulic fluid builds up pressure until pressure relief valve 405 reaches a set pressure, at which point, relief valve 405 allows the hydraulic fluid to return to reservoir 408. When solenoid valve 412A is energized to the A position, pressure acts on the upper side of piston 416A and drives the piston to the lower position in cylinder cavity 414A. Conversely, when solenoid valve 412A is in the B position pressure acts on the bottom side of piston 416A to move the piston to the upper position in cylinder cavity 414A. Note that the gate flow port 426A may be aligned with the seat orifice 431A on either the extension or retraction of piston 416A. The closing of the flow through seat orifice 431A can likewise occur on the other of extension or retraction of piston 416A, respectively. Each of the vent valves can be independently similarly operated. Each of the vent valve may be independently controlled by downhole controller 30 to operate as described in any of the embodiments described herein.

Figure 7:
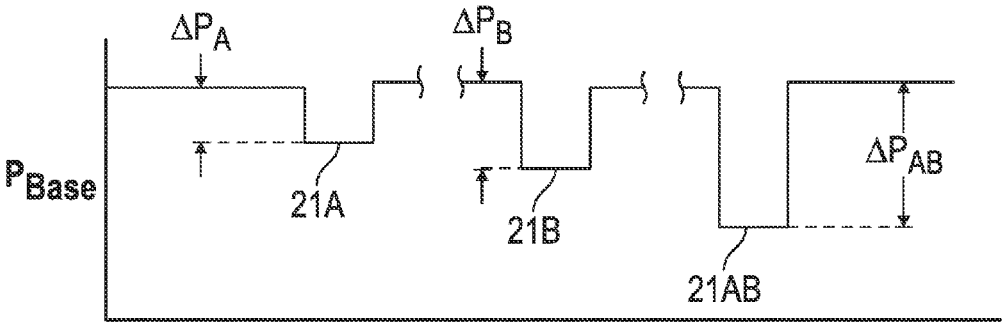
FIG. 7 shows an example of pulses generated by a pulser with multiple vent valves.

FIG. 7 refers to an example using two vent valves 421A and 421B, as described above, pulses may be generated at different times resulting in individual pulses 21A and 21B propagating through the drilling fluid 5 in drill string 14. The pulse amplitude, ΔP, of each pulse 21A and 21B is related to the size of the flow orifice in each valve seat. In one example, each valve seat 422A,B may have the same size orifice resulting in equal pulse amplitudes with the same flow conditions. Alternatively, each valve seat may have a different size orifice. As shown in FIG. 7, each valve seat has a different size orifice resulting in different pulse amplitudes, $\Delta P_A$ and $\Delta P_B$, with the same flow conditions. Either valve 421A or 421B may be independently operated resulting in the respective pulse amplitudes $\Delta P_A$ and $\Delta P_B$ as shown in FIG. 7. In another example, the valves 421A and 421B may be operated substantially simultaneously resulting in a pulse amplitude $\Delta P_{AB}$ that is approximately the sum of the pulse amplitudes of pulses 21A and 21B, at the same flow conditions as the individual pulses.

Figure 8:
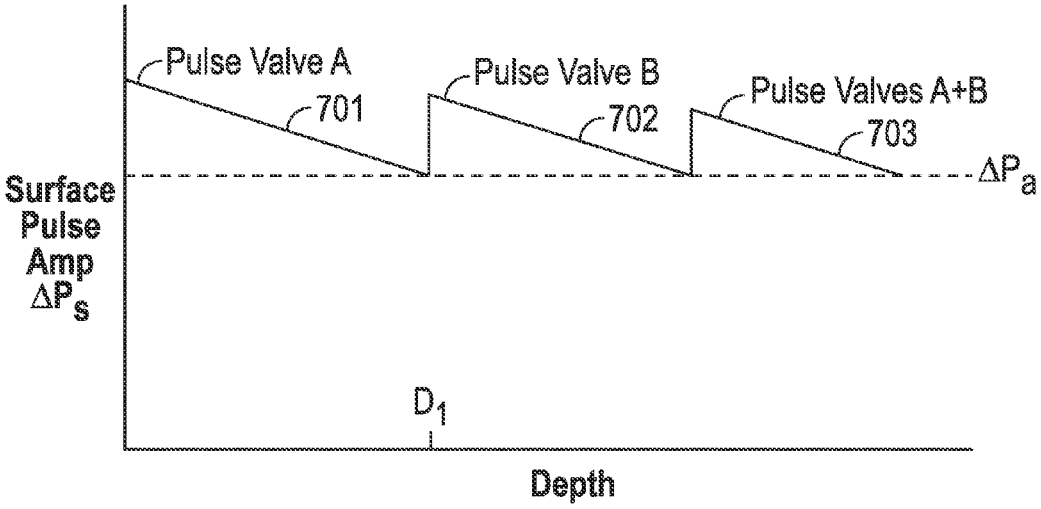
FIG. 8 shows an example of pulses generated by a dual valve pulser used in a drilling operation.

FIG. 8 shows an example of how the above dual valve pulser may be used in a drilling operation. FIG. 8 shows the surface pulse amplitude versus drilling depth during the drilling of a well. As used herein, drilling depth is the distance along the wellbore between the pulser location in the well to the surface. As one skilled in the art will appreciate, the pulse amplitude attenuates over distance from the source, assuming the fluid properties are substantially constant. In the example shown, a dual valve pulser has two valves, A and B, similar to valves 421A and 421B described above, where valve B has a larger compared to valve A. Initially, valve A is used to transmit pulses to the surface. As the pulser moves deeper, the pulse amplitude $\Delta P_s$ at the surface may be attenuated as compared to the initial pulse amplitude, as shown by attenuation line 701. Also shown in FIG. 8 is a minimum acceptable surface pulse amplitude $\Delta P_a$. When the surface pulse amplitude reaches the minimum acceptable amplitude, the pulser uses valve B to generate pulses. For example, surface downlink pulser 45 may transmit instructions to downhole sensor 203 directing downhole controller 30 to direct future downhole pulse transmission from valve B. The larger orifice in valve B generates acceptable pulses along line 702. Similarly, as the depth increases, the surface pulse amplitude along line 702 may again approach the minimum acceptable pulse amplitude, at which time instructions may be downlinked such that both valve A and valve B may be actuated simultaneously to generate pulses with surface amplitudes along line 703. The use of the valves A and B in this manner may greatly extend the ability of the downhole system to remain in the hole for a longer time. Without the addition of valve B, the tool may need to be withdrawn from the hole, at depth D1, to replace the valve with one having a larger orifice, or to replace the downhole tool itself with one having a larger valve orifice. Either replacement option requires additional trip time and associated expense. Alternatively, the generated pressure pulse amplitude may be measured downhole at pressure sensor 203. The detected downhole pressure amplitude may be evaluated by instructions and/or flow models in downhole controller 30 and the appropriate valve actuated to maintain the generated. The appropriate valve may be then actuated to maintain an acceptable generated pulse amplitude. While the downhole tool is described herein as having two independently actuatable valves, any number of additional independently actuatable valves may be disposed in the downhole tool. Each vent valve may be controlled by the same controller. Alternatively, each vent valve may be controlled by a separate controller where each controller is in data communication with each other controller to facilitate synchronization of valve actuation, when necessary.

In another operating scheme, valve A and valve B may have identical valve orifices, and one valve may be used as a primary valve and the other as a backup in case of primary valve failure. In one example, the number of valve actuations may be tracked in downhole controller 30, and valve B may be converted as the primary valve when valve A reaches a predetermined number of actuations.

In yet another operating scheme, valve A and valve B may have identical valve orifices, and may be actuated alternately such that each valve sees approximately a 50% duty cycle. The reduced duty cycle may substantially increase the available operating time in the hole.

In still another operating example, the pulser data transmission rate may be increased by transmitting different encoded data streams, by different vent valves, at the same time.

Numerous variations and modifications will become apparent to those skilled in the art. It is intended that the following claims be interpreted to embrace all such variations and modifications.

What is claimed is:

1. A drilling fluid telemetry pulser comprising:

a housing disposed in a drill string in a wellbore, the drill string having a drilling fluid flowing therein;

a plurality of vent valves disposed in the housing wherein each of the plurality of vent valves are actuatable to vent a portion of the drilling fluid from an interior of the drill string to an exterior of the drill string to generate a negative pressure pulse in the drilling fluid flowing in the drill string;

a hydraulic system to provide hydraulic power to actuate the at least one vent valve; and a downhole controller comprising a processor and a memory in data communication with the processor wherein the memory contains programmed instructions to control the actuation of the at least one vent valve, wherein each of the plurality of vent valves comprises a valve seat member having a through flow passage and a valve gate member acting cooperatively with the valve seat member to allow the drilling fluid to vent from the interior of the drill string to the exterior of the drill string when the valve gate is an open position and to prevent drilling fluid venting when the valve gate is in the closed position, wherein each through flow passage comprises a valve seat orifice to limit to flow through the flow passage, and wherein each of the plurality of valve seat orifices are different in size.

2. The drilling fluid telemetry puller of claim 1 further comprising a pressure sensor disposed proximate the puiser to receive downlink data and instructions.

3. The drilling fluid telemetry system of claim 1 further comprising an impeller to intercept at least a portion of the drilling fluid flow to drive at least one of a hydraulic pump and a downhole generator.

4. A method for generating negative pressure pulses in a drilling fluid flowing in a drill string in a well comprising:

disposing a plurality of vent valves in a pulser; and hydraulically actuating the at least one vent valve to generate negative pressure pulses in the drilling fluid flowing in the drill string, stalling a first valve seat orifice in a first vent valve of the plurality of vent valves and a second valve seat orifice in a second vent valve of the plurality of vent valves, and pulsing with at least one of: the first vent valve, the second vent valve, and the first vent valve and the second vent valve, to generate negative pressure pulses in the drilling fluid.

wherein the first valve seat orifice is larger than the second valve seat orifice.

5. The method of claim 4 further comprising selecting the first valve seat orifice and the second valve seat orifice to be the same size, and pulsing one of the first valve and the second valve for a predetermined number of pulses and then pulsing with the other of the first valve and the second valve.

6. The method of claim 4 wherein pulsing with at least one of the first vent valve, the second vent valve, and the first vent valve and the second vent valve is based at least in part on information downlinked from a surface location to a downhole controller.

7. The method of claim 4 further comprising selecting the first valve seat orifice and the second valve seat orifice to be the same size, and pulsing the first valve and the second valve in an alternating pattern to increase valve life.

8. The method of claim 4 further comprising selecting the first valve seat orifice and the second valve seat orifice to be the same size, and transmitting a first data stream with the first vent valve and a second data stream with the second vent valve at substantially the same time.

9. A drilling fluid telemetry pulser comprising:

a housing disposed in a drill string in a wellbore, the drill string having a drilling fluid flowing therein;

a plurality of vent valves disposed in the housing wherein each of the plurality of valves is independently actuatable to vent a portion of the drilling fluid from an interior of the drill string to an exterior of the drill string to generate a negative pressure pulse in the drilling fluid flowing in the drill string;

a hydraulic system to provide hydraulic power to actuate each of the plurality of valves; and a downhole controller comprising a processor and a memory in data communication with the processor wherein the memory contains programmed instructions to control the actuation of each of the plurality of valves, wherein the through flow passage of each of the plurality of valves comprises a valve seat orifice; and wherein the valve seat orifice of each of the plurality of valves is a different size.

10. The drilling fluid telemetry puller of claim 9 wherein each of the plurality of valves comprises a valve seat member having a through flow passage and a valve gate member acting cooperatively with the valve seat member to allow the drilling fluid to vent from the interior of the drill string to the exterior of the drill string when the valve gate is in an open position and to prevent drilling fluid venting when the valve gate is in the closed position.

11. The drilling fluid telemetry pulser of claim 9 further comprising a pressure sensor disposed proximate the pulser to receive downlink data and instructions.

12. The drilling fluid telemetry system of claim 9 further comprising an impeller to intercept at least a portion of the drilling fluid flow to drive at least one of a hydra pump and a downhole generator.

13. A method for generating negative pressure pulses in drilling fluid flowing in a drill string in a well comprising:

disposing a plurality of independently actuatable vent valves in a pulser; and installing a first valve seat orifice in a first vent valve and a second valve seat orifice in a second vent valve;

controllably actuating at least one of the plurality of vent valves to generate negative pressure pulses in the drilling fluid flowing in the drill string; and pulsing with at least one of; the first vent valve, the second vent valve, and the first vent valve and the second vent valve, wherein the first valve seat orifice and the second valve seat orifice are different in size.

14. The method of claim 13 further comprising selecting the first valve seat orifice and the second valve seat orifice to be the same size, and pulsing one of the first valve and the second valve for a predetermined number of pulses and then pulsing with the other of the first valve and the second valve.

15. The method of claim 13 wherein pulsing with at least one of the first vent valve, the second vent valve, and the first vent valve and the second vent valve is based at least in part on information downlinked from a surface location to a downhole controller.

16. The method of claim 13 further comprising selecting the first valve seat orifice and the second valve seat orifice to be the same size, and pulsing the first valve and the second valve in art alternating pattern to increase valve life.

17. The method of claim 13 further comprising selecting the first valve seat orifice and the second valve seat orifice to be the same size, and transmitting a first data stream with the first vent valve and a second data stream with the second. vent valve at substantially the same time.

18. The drilling fluid telemetry pulses of claim 1, wherein a first valve seat orifice of the plurality of valve seat orifices is larger than a second valve seat orifice of the plurality of valve seat orifices.

* * * * *